US006370352B1

(12) United States Patent
Tomita

(10) Patent No.: US 6,370,352 B1
(45) Date of Patent: Apr. 9, 2002

(54) METHOD AND APPARATUS FOR IMAGE FORMING CAPABLE OF EFFECTIVELY PERFORMING AN IMAGE FIXING PROCESS

(75) Inventor: Kunihiko Tomita, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/716,945

(22) Filed: Nov. 22, 2000

(30) Foreign Application Priority Data

Nov. 24, 1999 (JP) ..... 11-332716

(51) Int. Cl.[7] ..... G03G 15/20
(52) U.S. Cl. ..... 399/328; 399/329
(58) Field of Search ..... 399/321, 328, 399/329, 341; 430/124

(56) References Cited

U.S. PATENT DOCUMENTS 5,319,429 A * 6/1994 Fukuchi et al. ..... 399/321

* cited by examiner

*Primary Examiner*—Joan Pendegrass
(74) *Attorney, Agent, or Firm*—Oblon, Spivak, McClelland, Maier & Neustadt, P.C.

(57) ABSTRACT

An image fixing apparatus includes a fixing member and a pair of pressure applying members. The fixing member transfers and applies heat to a recording sheet including a toner image. The pressure applying members are mounted opposite to the fixing member relative to the recording sheet and apply pressure to the recording sheet from a back side thereof. The fixing member applies heat to the toner until the temperature becomes a state higher than one of softening and melting points. The heat is removed and the melted toner cools to a temperature below one of the softening and melting points. The fixing member has a thickness of S micrometers within a range of from approximately 1.0 $\mu$m to approximately 300 $\mu$m, and a tension within a range of one of from approximately ((S+99)/50000×9.8 100 N/m to approximately ((29S+371)×3/50000)×9.8×100 N/m and from approximately ((S+99/40000)×9.8×100 N/m to approximately ((29S+371)×3/40000)×9.8×100 N/m.

19 Claims, 5 Drawing Sheets

METHOD AND APPARATUS FOR IMAGE FORMING CAPABLE OF EFFECTIVELY PERFORMING AN IMAGE FIXING PROCESS

CROSS-REFERENCE TO RELATED APPLICATIONS

This application claims priority to Japanese patent application No. JPAP11-332716 filed on Nov. 24, 1999 in the Japanese Patent Office, the entire contents of which is incorporated by reference herein.

BACKGROUND OF THE INVENTION

1. Field of the Invention

The present invention relates to a method and apparatus for image forming, and more particularly to a method and apparatus for image forming that is capable of effectively performing an image fixing process.

2. Discussion of the Background

An image forming apparatus that forms an image with toner based on an electrophotographic printing method has come into widespread usage in a variety of products, such as a copying machine, a printing machine, a facsimile machine, etc. In the electrophotographic printing method, a latent image formed with an electrostatic force is dusted with toner so that a toner image is generated and which is then transferred onto a recording sheet. The toner image thus placed on the recording sheet is then subjected to a fixing process in which the toner image is fixed onto the recording sheet, generally, by applications of heat and pressure using rollers, so that an image is firmly formed on the recording sheet.

The toner used in the above-mentioned image forming apparatus generally has a property of an extremely high viscosity as a plastic within a range of from a softening state to a state before a perfectly melted state (i.e., often referred to as a rubber-like-state range). Such toner thereby has a relatively high self-condensing force. Therefore, such toner is not prone to cause an offset problem in which the toner makes a deposition on a part of a fixing member, such as a roller for applying heat and pressure to the toner and the recording sheet.

In the perfectly melted state, however, the toner greatly decreases the viscosity of the plastic, which accordingly decreases the self-condensing force. As a result, the toner is likely to cause the above-mentioned offset problem. Therefore, an actual fixing process by heat is conducted with the toner in the rubber-like-state.

A melting point of the plastic used for the toner requiring a relatively high viscosity in the rubber-like-state is relatively high and, therefore, the fixing temperature is necessarily increased. Thereby, the fixing process in the image forming apparatus consumes relatively great heat energy.

In response to a recent increasing movement of saving energy and natural resources for a global environmental conservation, efforts for reducing electric power consumption have been put into practice, even in an image forming apparatus. The fixing process particularly requiring a high electric power consumption, as described above, is under a process to change into a low-temperature fixing process. To put it this concept into practice, the toner is required to have a relatively low softening point or melting point. With such a lowered softening point or melting point, the thermoplastic resin used in the toner characteristically shows a relatively low melting viscosity.

The melting viscosity in this case is referred to be as the one either at a temperature of the softening point or at a temperature higher than the melting point. More specifically, such softening and melting points correspond to softening and flow-start temperatures, respectively, for example, as specified by Shimadzu Corporation, Japan, for a measurement with a flow-tester manufactured by Shimadzu Corporation. In addition, the rubber-like-state corresponds to a range of from a softening temperature to a flow-start temperature.

The above-mentioned characteristics of the thermoplastic resin are determined by various factors, such as a softening point or a melting point, a molecular weight of the resin, a distribution of the molecular weight, an extent of crystallization, an extent of bridging between the molecules, an intermolecular force, etc. Among these factors, it is possible to lower the softening point or melting point of a resin having the same structure by lowering the molecular weight or the extent of bridging or by narrowing the distribution of the molecular weight. The distribution of the molecular weight, however, has a lower limit defined by a life limit of the resin and, if the molecular weight itself is lowered, the distribution of the molecular weight is necessarily narrowed. In general, a reduction of a molecular weight makes chains of the molecules shorter, which then causes relatively loose connections between the molecules, so that the melting viscosity is lowered. If the distribution of the molecular weight is narrowed, the connections between the molecules are loosened and as a result, the melting viscosity is also lowered. Further, if the extent of bridging between the molecules is lowered, each molecule is made more mobile and as a result, the melting viscosity is lowered.

For example, Japanese Laid-Open unexamined application, publication number 51-29825, describes a fixing method of electrophotography, which uses a fixing station using a film sheet as a part of a fixing member. In this method, after applying heat to a recording sheet, the fixing station conducts a cooling process for cooling the film sheet and the recording sheet, while holding them in close contact with each other. Upon completion of the cooling process, by which time the toner is hardened, the fixing station removes the film sheet from the recording sheet. This method includes a forced cooling process, such as cooling with a fan and cooling with water.

Japanese Laid-Open unexamined applications, publication numbers 63-118291, 63-118292, and 63-118293, describe a thermal transfer recording method. This method fixes a hot-melt print medium, which includes wax as a main component and therefore has a relatively low viscosity, relative to a film, even during a continuous print operation, avoiding the offset problem. In general, the print medium used in the thermal transfer recording includes wax as a main component thereof and the viscosity of such wax is in the range of approximately between $10–10^4$ [c poise], which assures relief of the offset problem.

The above thermal transfer recording method uses a technique, which removes a film sheet from a recording sheet after a temperature of the hot-melt print medium, measured with a differential scanning calorimeter (DSC), is reduced below a temperature of a top peak value, after the hot-melt print medium is applied with heat and is melted. Specifically, Japanese Laid-Open unexamined application, publication number 63-118291, describes a forced cooling method, such as with cool blown air using a refrigerant, such as water, Freon gas, etc. Japanese Laid-Open unexamined application, publication number 63-118292, describes a method for transporting a film sheet and a recording sheet together in close contact through a cooling station. Japanese Laid-Open unexamined application, publication number 63-118293, describes a mechanism for separating a film sheet from a recording sheet and also a mechanism for holding the film sheet and the recording sheet together in close contact until the film sheet is separated from the recording sheet.

The above techniques used in the above-mentioned thermal transfer recording methods solve a problem of print medium deposition on the film sheet and which is deemed to be similar to the above-mentioned offset problem in the electrophotography fixing process. Hence, an electrophotography image forming apparatus utilizing the above-mentioned techniques has been developed, which can therefore fix a toner image with a toner of a comparatively lower melting viscosity. Such an electrophotography image forming apparatus can use a toner of the melting viscosity at the conventional level, such as the one greater than $10^{13}$ [c poise], without a problem. This image forming apparatus does not cause the offset problem, but creates another problem when using a toner of the melting viscosity smaller than $10^{13}$ [c poise].

Specifically, toner having melting viscosity lower than $10^{13}$ [c poise] has a better contact to the fixing member, which increases an adherence force between the toner and the fixing member when the toner is hardened. However, the condensing force of the toner is still stronger than such adherence force between the toner and the fixing member after the toner is hardened. Therefore, the recording sheet can be removed from the fixing member without causing the offset problem. However, since the adherence force generated between the toner and the fixing member is unnecessarily strong, it is prone to give a non-uniform tension to the fixing member, which has a belt-like shape and is held between rollers, when the recording sheet is removed from the fixing member. When the fixing member has a non-uniform tension, it tends to inconsistently move or to generate wrinkles on the surface thereof. This tendency is increased with a decrease of the melting viscosity. That is, when lower viscosity toner is used, the adherence force between the toner and the fixing member is comparatively stronger. Then, when the recording sheet is removed from the fixing member, the fixing member may have a non-uniform tension or generate wrinkles on the surface thereof.

The thinner the thickness of the fixing member, the better the heat conductivity thereof. However, when the fixing member is too thin, it may be extended or distorted by the tension of the fixing member. On the other hand, if the fixing member is made thick, heat conductivity thereof is reduced, resulting in a higher heat requirement.

In addition, if the fixing member (e.g., the fixing belt) is thick, hardness thereof is increased, resulting in relatively stronger tension over supporting members (e.g., rollers). This requires the mechanism itself for supporting the fixing member to have a relatively strong structure, resulting in an increase of a manufacturing cost of the fixing mechanism.

SUMMARY OF THE INVENTION

The present invention provides a novel image fixing apparatus. In one example, a novel image fixing apparatus includes a fixing member and a pair of pressure applying members. The fixing member is configured to transfer a recording sheet having an image of toner thereon and to apply heat to a front surface of the recording sheet. The pair of pressure applying members are mounted opposite to the fixing member relative to the recording sheet and are configured to apply pressure to the recording sheet from a back side thereof. In this image fixing apparatus, the fixing member applies heat to the toner so that the toner becomes in a state higher than one of softening and melting points and, when the toner is melted, the fixing member stops applying heat to the toner so that the melted toner is cooled down and, when a temperature of the toner is reduced below one of the softening and melting points, the recording sheet is removed from the fixing member. Further, in this image fixing apparatus, the toner has a viscosity within a range of from approximately 10 c poise to approximately $10^{13}$ c poise and the fixing member has a thickness within a range of from approximately 1.0 $\mu$m to approximately 300 $\mu$m.

The fixing member may have a thickness of S $\mu$m and a tension within a range of from approximately $((S+99)/50000)\times 9.8\times 100$ N/m to approximately $((29S+371)\times 3/50000)\times 9.8\times 100$ N/m.

The fixing member may have a thickness of S $\mu$m the fixing member has a tension within a range of from approximately $((S+99)/40000)\times 9.8\times 100$ N/m to approximately $((29S+371)\times 3/40000)\times 9.8\times 100$ N/m when an extension of the fixing member by an increase of the temperature is taken into account.

The fixing member may be applied with the tension using one of a spring, a guide roller, and a dancer roller, and may include a fixing member may include a belt.

The present invention further provides a novel method of image fixing. In one example, a novel method includes the steps of receiving, applying, stopping, and ejecting. The receiving step receives a recording sheet having an image of toner thereon. The transferring step transfers the recording sheet. The applying step applies heat and pressure to the recording sheet so that the toner becomes in a state higher than one of softening and melting points and is melted. The stopping step stops applying heat to the toner so that the melted toner is cooled down. The ejecting step ejects the recording sheet when a temperature of the toner is reduced below one of the softening and melting points. In this novel method, the toner has a viscosity within a range of from approximately 10 c poise to approximately $10^{13}$ c poise and the fixing means has a thickness within a range of from approximately 1.0 $\mu$m to approximately 300·m.

The transferring step may use a belt having a thickness of S $\mu$m and a tension within a range of from approximately $((S+99)/50000)\times 9.8\times 100$ N/m to approximately $((29S+371)\times 3/50000)\times 9.8\times 100$ N/m.

The transferring step may use a belt having a thickness of S $\mu$m and a tension within a range of from approximately $((S+99)/40000)\times 9.8\times 100$ N/m to approximately $((29S+371)\times 3/40000)\times 9.8\times 100$ N/m when an extension of the belt by an increase of the temperature is taken into account.

The belt is applied with the tension using one of a spring, a guide roller, and a dancer roller.

The present invention further provides a novel image forming apparatus. In one example, a novel image forming apparatus includes a fixing station which includes a fixing member and a pair of pressure applying members. The fixing member is configured to transfer a recording sheet having an image of toner thereon and to apply heat to a front surface of the recording sheet. The pair of pressure applying members are mounted opposite to the fixing member relative to the recording sheet and are configured to apply pressure to the recording sheet from a back side thereof. In this novel image forming apparatus, the fixing member may apply heat to the toner so that the toner becomes in a state higher than one of softening and melting points and, when the toner is melted, the fixing member stops applying heat to the toner so that the melted toner is cooled down and, when a temperature of the toner is reduced below one of the softening and melting points, the recording sheet is removed from the fixing member. Further, in this novel image forming apparatus, the toner may have a viscosity within a range of from approximately 10 c poise to approximately $10^{13}$ c poise and the fixing member has a thickness within a range of from approximately 1.0 $\mu$m to approximately 300 $\mu$m.

BRIEF DESCRIPTION OF THE DRAWINGS

A more complete appreciation of the present application and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
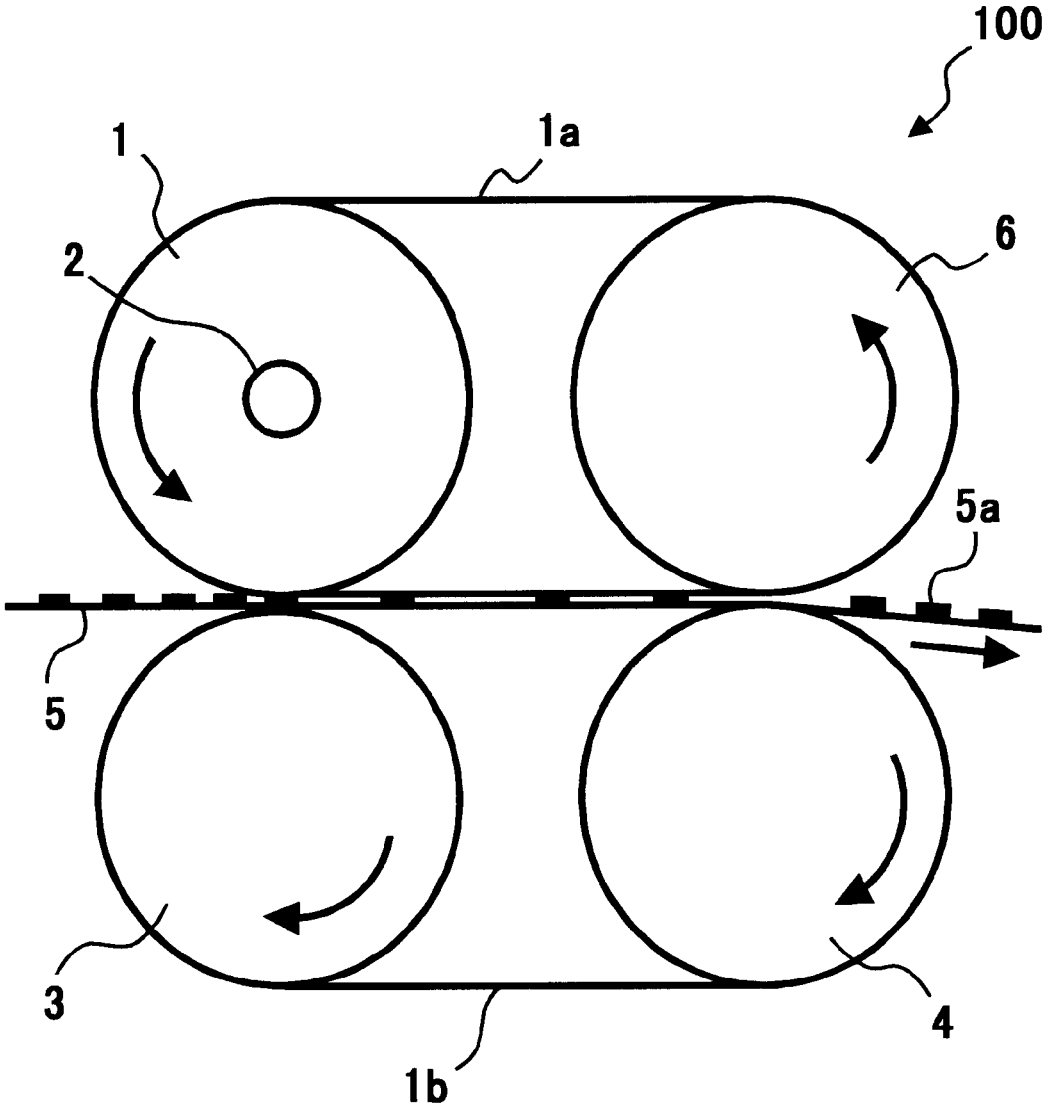
FIGS. 1–6 are schematic diagrams for showing different examples of a fixing station for use in an image forming apparatus according to an embodiment of the present invention.

In describing preferred embodiments illustrated in the drawings, specific terminology is employed for the sake of clarity. However, the invention is not intended to be limited to the specific terminology so selected and it is to be understood that each specific element includes all technical equivalents, which operate in a similar manner.

Referring now to the drawings, like reference numerals designate identical or corresponding parts throughout the several views. As shown in FIG. 1, a first example of a fixing station employed in an electrophotographic image forming apparatus according to an embodiment of the present invention is explained. The first example of the fixing station shown in FIG. 1 is a fixing unit 100. In this electrophotographic image forming apparatus, the fixing unit 100 includes a fixing roller 1, a fixing belt 1*a*, a supporting belt 1*b*, a heater 2, pressure rollers 3 and 4, and a cooling roller 6. As shown in FIG. 1, the fixing roller 1 is configured to wrap the heater 2. The fixing roller 1 and the cooling roller 6 are rotated counterclockwise and the pressure rollers 3 and 4 are rotated clockwise. Also, FIG. 1 shows a manner of a fixing operation in which a sheet 5 having a deposition of toner 5*a* on its surface is being conveyed by the fixing roller 1 and the pressure roller 3 that presses the sheet 5 to the fixing roller 1 via the fixing belt 1*a* and the supporting belt 1*b* and by the cooling roller 6 and the pressure roller 4 that presses the sheet 5 to the cooling roller 6 via the fixing belt 1*a* and the supporting belt 1*b*. While the sheet 5 is being conveyed through the fixing unit 100, as described above, the fixing roller 1 heated with the heater 2 (e.g., a halogen lamp) heats the toner 5*a* deposited on the surface of the sheet 5 via the fixing belt 1*a* so that the toner 5*a* is melted on the sheet 5 and the cooling roller 6 cools the temperature of the melted toner via the supporting belt 1*b* so that the toner 5*a* is fixed onto the sheet 5. When the sheet 5 is released from the fixing belt 1*a* and the supporting belt 1*b*, the temperature of the toner 5*a* is reduced below the softening or melting point of the toner 5*a*.

Figure 2:
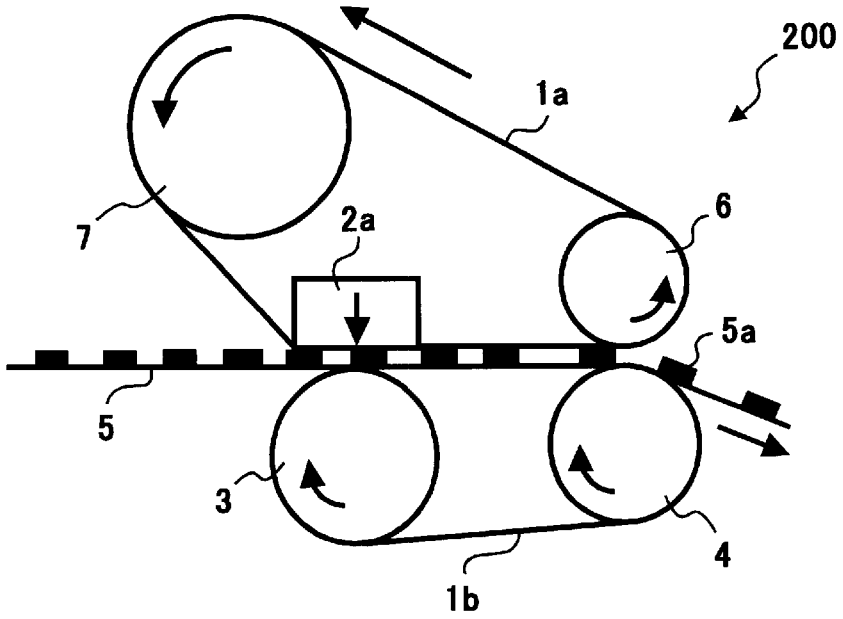

FIG. 2 shows a second example of the fixing station employed in the electrophotographic image forming apparatus according to an embodiment of the present invention. The second example of the fixing station shown in FIG. 2 is a fixing unit 200. The fixing unit 200 of FIG. 2 is similar to the fixing unit 100 of FIG. 1, except for an arrangement in which a supporting roller 7 and a linearly-shaped heater 2*a* are separately used in place of the heater 2. The supporting roller 7 is rotated counterclockwise and the linearly-shaped heater 2*a* is driven to produce heat to heat the toner 5*a* via the fixing belt 1*a*.

With this configuration, the sheet 5 is being conveyed by the supporting roller 7 and the pressure roller 3 that presses the sheet 5 to the heater 2*a* via the fixing belt 1*a* and the supporting belt 1*b* and by the cooling roller 6 and the pressure roller 4 that presses the sheet 5 to the cooling roller 6 via the fixing belt 1*a* and the supporting belt 1*b*. While the sheet 5 is being conveyed through the fixing unit 200, as described above, the linearly-shaped heater 2*s* heats the toner 5*a* deposited on the surface of the sheet 5 via the fixing belt 1*a* so that the toner 5*a* is melt on the sheet 5 and the cooling roller 6 cools the temperature of the melted toner via the supporting belt 1*b* so that the toner 5*a* is fixed onto the sheet 5. When the sheet 5 is released from the fixing belt 1*a* and the supporting belt 1*b*, the temperature of the toner 5*a* is reduced below the softening or melting point of the toner 5*a*.

Figure 3:
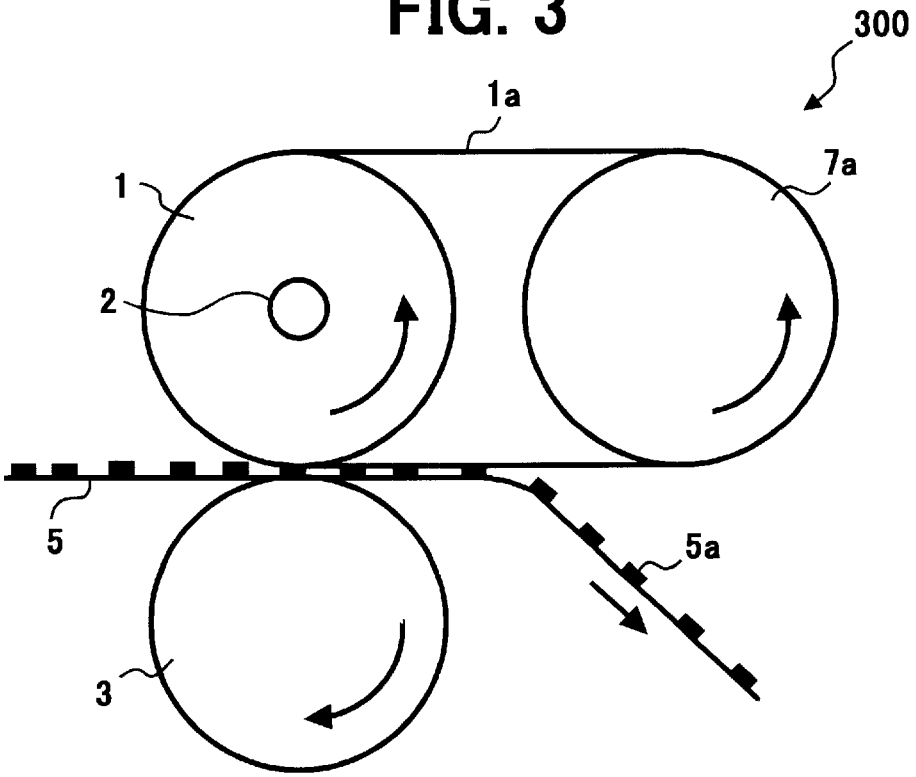

A third example of the fixing station employed in the electrophotographic image forming apparatus according to an embodiment of the present invention is shown in FIG. 3. The third example of the fixing station shown in FIG. 3 is a fixing unit 300. The fixing unit 300 of FIG. 3 is similar to the fixing unit 100 of FIG. 1, except for an arrangement in which a supporting roller 7*a* is added to and the supporting belt 1*b*, the pressure roller 4, and the cooling roller 6 are excluded from the fixing unit 100. In the fixing unit 300, the supporting roller 7*a* is rotated counterclockwise, and the cooling process is performed by an air cooling.

With this configuration, the sheet 5 is being conveyed by the fixing roller 1 via the fixing belt 1*a* and the pressure roller 3. While the sheet 5 is being conveyed through the fixing unit 300, as described above, the fixing roller 1 heats the toner 5*a* deposited on the surface of the sheet 5 via the fixing belt 1*a* so that the toner 5*a* is melt on the sheet 5 and the melted toner 5*a* is cooled by air so that the toner 5*a* is fixed onto the sheet 5. When the sheet 5 is released from the fixing belt 1*a*, the temperature of the toner 5*a* is reduced below the softening or melting point of the toner 5*a*.

In the above-mentioned fixing stations 100, 200, and 300, the fixing belt 1*a* is inevitably extended by the high temperature. Therefore, the extension of the fixing belt 1*a* by the high temperature is taken into account when the fixing belt 1*a* is put on the rollers (e.g., the fixing roller and so on). More specifically, when the belt-shaped fixing member including a film or a sheet has a thickness S in a range of from 1.0 $\mu$m to 300 $\mu$m, the tension T is preferably set in a range of from $(S+99)/40000$ to $(29S+371)\times 3/40000$, wherein T is represented in units of $9.8\times 100$ N/m.

Figure 4:
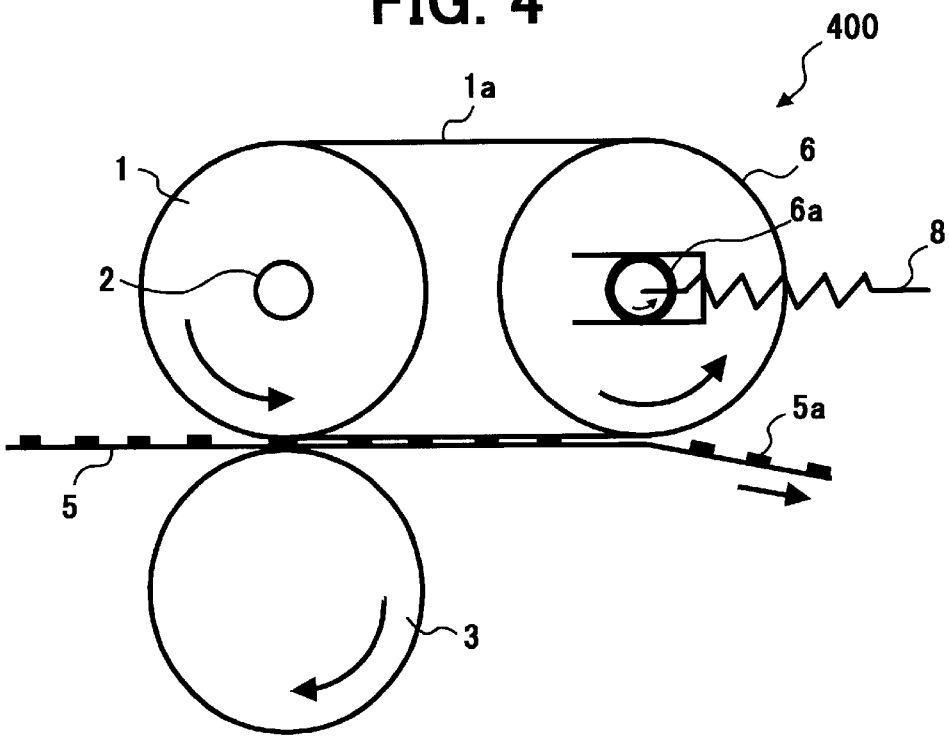

A fourth example of the fixing station employed in the electrophotographic image forming apparatus according to an embodiment of the present invention is shown in FIG. 4. The fourth example of the fixing station shown in FIG. 4 is a fixing unit 400. The fixing unit 400 of FIG. 4 is similar to the fixing unit 100 of FIG. 1, except for an arrangement in which a spring 8 (e.g., a leaf spring or a coil spring) is added to and the supporting belt 1*b* and the pressure roller 4 are excluded from the fixing unit 100. In the fixing unit 400, the cooling roller 6 includes a shaft 6*a* and is held movably in a horizontal direction. The cooling roller 6 is used also as a guide roller for guiding the recording sheet 5 along a predetermined sheet path. As shown in FIG. 4, the spring 8 is hooked between a frame of the fixing unit 400 and the shaft 6*a* of the cooling roller 6 and pulls the cooling roller 6 in the horizontal direction such that the fixing belt 1*a* keeps a predetermined constant tension.

Figure 5:
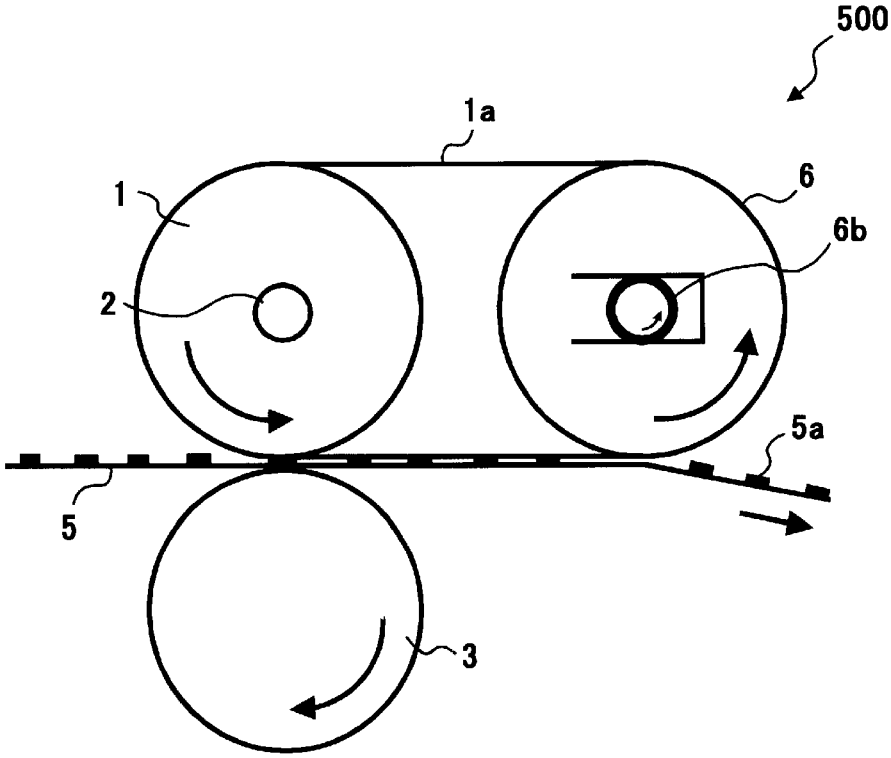

A fifth example of the fixing station employed in the electrophotographic image forming apparatus according to an embodiment of the present invention is shown in FIG. 5. The fifth example of the fixing station shown in FIG. 5 is a fixing unit 500. The fixing unit 500 of FIG. 5 is similar to the fixing unit 100 of FIG. 1, except for an arrangement in which the supporting belt 1*b* and the pressure roller 4 are excluded from the fixing unit 100. In the fixing unit 500, the cooling roller 6 includes a driving shaft 6*b* and is held movably in a horizontal direction. The fixing unit 500 is used also as a guide roller for guiding the recording sheet 5 along a predetermined sheet path. When the driving shaft 6*b* of the cooling roller 6 is rotated, it generates a friction force, which moves the cooling roller 6 such that the fixing belt 1*a* keeps a predetermined constant tension.

Figure 6:
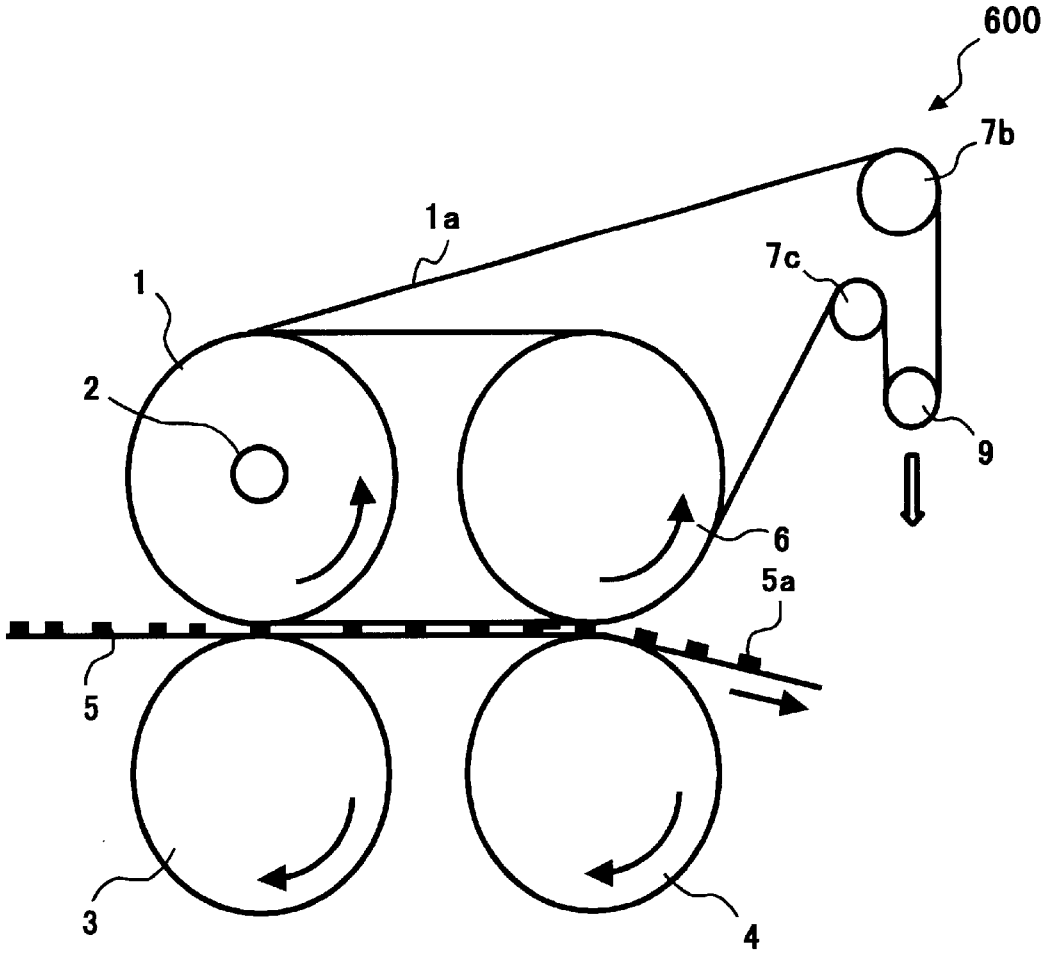

A sixth example of the fixing station employed in the electrophotographic image forming apparatus according to an embodiment of the present invention is shown in FIG. 6. The sixth example of the fixing station shown in FIG. 6 is a fixing unit 600. The fixing unit 600 of FIG. 6 is similar to the fixing unit 100 of FIG. 1, except for an arrangement in which supporting rollers 7*b* and 7*c* and a dancer roller 9 are added to the fixing unit 100. In the fixing unit 600, the dancer roller 9 is held movably in a vertical direction by the fixing belt 1*a* hanged over the supporting rollers 7*b* and 7*c*. When the fixing belt 1*a* is extended, the dancer roller 9 moves downwards with its own weight such that the fixing belt 1*a* keeps a predetermined constant tension.

Next, a relationship between the thickness and the tension of the fixing member (e.g., the fixing belt 1*a*) is explained with reference to Tables 1 and 2 and FIG. 7. It must be noted that the fixing member can be made of any one of many raw materials of synthetic resins including polyester, polycarbonate, polyetereterketone, polysulfone, polyamid, polyimide, polytetrafluoroethylene, and so on or metals including iron, nickel, copper, aluminum, and so on. It must further be noted that the performance of the fixing member according to the present invention is not affected by the kind of the raw material used for the fixing member.

Table 1 below shows conditions for an experiment of the fixing operation using four different samples of the fixing members. In Table 1, a value of the thickness S is in $\mu$m and a value of the tension T is in units of 9.8×100 N/m.

TABLE 1

| Sample | Raw material used | Thickness S | Tension T |
|---|---|---|---|
| Sample A | Polyester film | 1 | 0.7 |
| Sample B | Polyester film | 12 | 0.015 |
| Sample C | Polyester film | 12 | 0.05 |
| Sample D | Polyimide film | 400 | 0.5 |

In the case using the sample A, the fixing member was not loosened but was distorted by the action of the recording sheet. Specifically, when the recording sheet was removed from the fixing member having the thickness and the tension for the sample A, as shown in Table 1, the fixing member was pulled by the fixed toner image of the recording sheet. As a result, the fixing member was partly extended and was distorted.

In the case of the sample B, the fixing member was not distorted but was caused to inconsistently move and to have wrinkles by the action of the recording sheet. When the recording sheet was removed from the fixing member having the thickness and the tension for the sample B, as shown in Table 1, the fixing member was pulled by the fixed toner image of the recording sheet. As a result, the fixing member was loosened and was caused to inconsistently move and to have wrinkles.

In the case of the sample C, the fixing member was not loosened but was distorted by the action of the recording sheet. When the recording sheet was removed from the fixing member having the thickness and the tension for the sample C, as shown in Table 1, the fixing member was pulled by the fixed toner image of the recording sheet. As a result, the fixing member was entirely extended and was distorted.

In the case of the sample D, the fixing member was not distorted and was not caused to inconsistently move nor to have wrinkles by the action of the recording sheet. In this case, however, the fixing member having the thickness and the tension for the sample D, as shown in Table 1, was caused to lose heat by the number of the continuous fixing operations. Thus, the fixing member was not kept at a predetermined constant fixing temperature and caused an erroneous fixing performance. Although it may be possible to solve this problem by increasing the predetermined temperature of the heater by 40 degrees or more, such a solution is not in accordance with the efforts paid for the energy saving.

Based on the examination of the above-mentioned experiments, Applicant found that the above problem can be solved when the fixing member has a thickness S in a range of from 1.0 $\mu$m to 300 m and is adjusted to have a tension T in a range of from (S+99)/50000 to (29S+371)×3/50000, wherein a value of the tension T is in units of 9.8×100 N/m.

Table 2 below shows conditions for an experiment of the fixing operation using six different samples of the fixing members. In Table 2, a value of the thickness S is in $\mu$m and a value of the tension T is in units of 9.8×100 N/m.

TABLE 2

| Sample | Raw material used | Thickness S | Tension T |
|---|---|---|---|
| Sample E | Polyester film | 12 | 0.03 |
| Sample F | Polycarbonate film | 25 | 0.05 |
| Sample G | Polyimide film | 50 | 0.08 |
| Sample H | Nickel belt | 200 | 0.2 |
| Sample I | Polyetereterketone film | 100 | 0.15 |
| Sample J | Polysulfone film | 100 | 0.11 |

In the case of the sample E, the fixing member was not loosened and was not caused to inconsistently move nor to have wrinkles by the action of the recording sheet when the recording sheet was removed from the fixing member. That is, the fixing member having the thickness and the tension for the second sample, as shown in Table 2, properly performs a stable fixing operation.

Likewise, in each case of the samples F to J, the fixing member was not loosened and was not caused to inconsistently move nor to have wrinkles by the action of the recording sheet when the recording sheet was removed from the fixing member.

Figure 7:
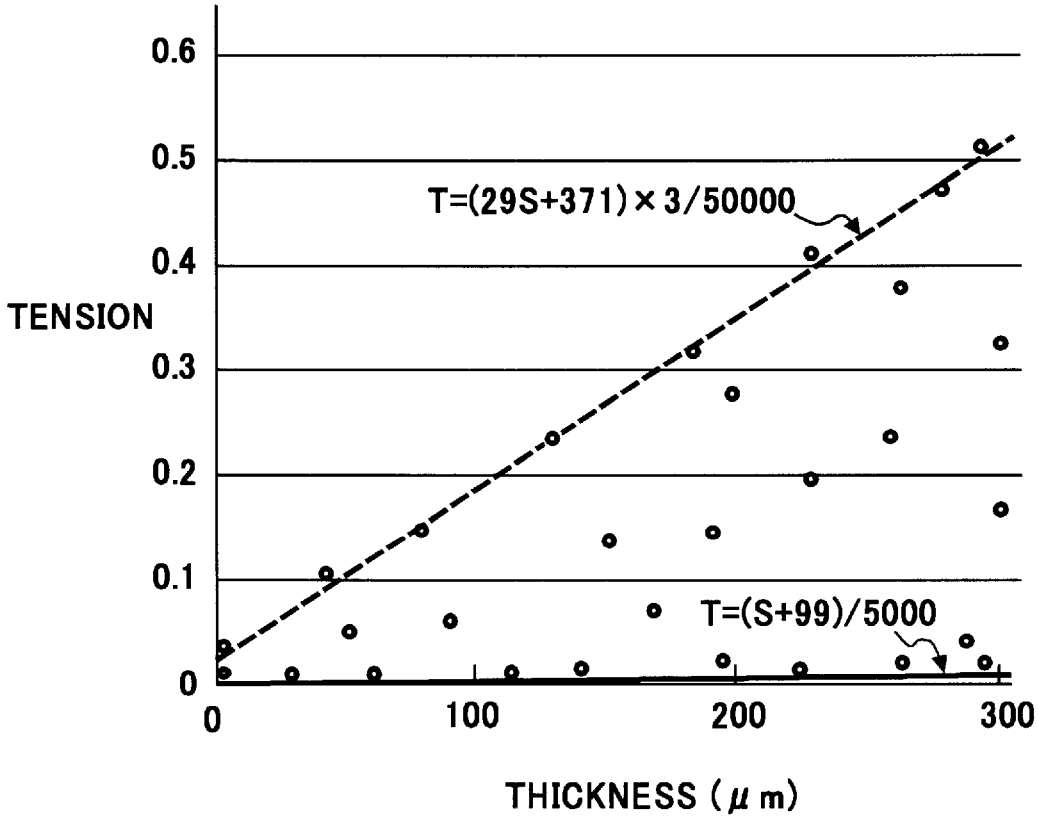
FIG. 7 is a graph for explaining a relationship between a thickness of a fixing member and a preferable tension to be provided to the fixing member in each of the fixing stations of FIGS. 1–6.

As shown in FIG. 7, the above-mentioned results are approximately within an area surrounded by two tension-thickness lines having slopes of (S+99)/50000[9.8×100 N/m] and (29S+371)×3/50000[9.8×100 N/m]. If the tension T is above the upper limit, the fixing member is stretched. If the tension T is below the lower limit, the fixing member is loosened or cannot be moved smoothly along a guide due to the hardness of the fixing member.

Thus, the fixing station according to the present invention can keep the fixing member at a predetermined tension under the high temperature during the fixing process, while avoiding the problem in that the fixing member is loosened and is caused to inconsistently move nor to have wrinkles.

Numerous additional modifications and variations of the present application are possible in light of the above teachings. It is therefore to be understood that within the scope of the appended claims, the present application may be practiced otherwise than as specifically described herein.

What is claimed as new and is desired to be secured by Letter Patent of the United States is:

1. A fixing apparatus, comprising:

a fixing member configured to transfer a recording sheet having a toner image thereon and to apply heat to a front surface of said recording sheet;

a pair of pressure applying members mounted opposite to said fixing member relative to said recording sheet and configured to apply pressure to said recording sheet from a back side thereof;

wherein said fixing member applies heat to said toner so that said toner becomes in a state higher than one of softening and melting points;

when said toner is melted, said fixing member stops applying heat to said toner so that the melted toner is cooled down;

when a temperature of said toner is reduced below one of said softening and melting points, said recording sheet is removed from said fixing member; and said fixing member has a thickness of S $\mu$m within a range of from approximately 1.0 $\mu$m to approximately 300 $\mu$m and a tension within a range of one of from approximately ((S+99)/50000×9.8 100 N/m to approximately ((29S+371)×3/50000)×9.8×100 N/m and from approximately ((S+99/40000)×9.8×100 N/m to approximately ((29S+371)×3/40000)×9.8×100 N/m.

2. The fixing member as defined in claim 1, wherein said fixing member is applied with said tension using a spring.

3. The fixing member as defined in claim 1, wherein said fixing member is applied with said tension by a driving friction force of a guide roller.

4. The fixing member as defined in claim 1, wherein said fixing member is applied with said tension by a weight of a dancer roller.

5. The fixing member as defined in claim 1, wherein said fixing member includes a belt.

6. The fixing apparatus as defined in claim 1, wherein said toner has a viscosity within a range of from approximately 10 c poise to approximately $10^{13}$ c poise.

7. A fixing apparatus, comprising:

fixing means for transferring a recording sheet having a toner image thereon and for applying heat to a front surface of said recording sheet;

pressure applying means, mounted opposite to said fixing means relative to said recording sheet, for applying pressure to said recording sheet from a back side thereof; wherein said fixing means applies heat to said toner so that said toner becomes in a state higher than one of softening and melting points;

when said toner is melted, said fixing means stops applying heat to said toner so that the melted toner is cooled down;

when a temperature of said toner is reduced below one of said softening and melting points, said recording sheet is removed from said fixing means; and said fixing means has a thickness of S $\mu$m within a range of from approximately 1.0 $\mu$m to approximately 300 $\mu$m and a tension within a range of one of from approximately ((S+99)/50000×9.8×100 N/m to approximately ((29S+371×3/50000)×9.8×100 Nm and from approximately ((S+99/40000)×9.8×100 N/m to approximately ((29S+371)×3/40000)×9.8×100 N/m.

8. The fixing member as defined in claim 7, wherein said fixing means is applied with said tension using a spring.

9. The fixing member as defined in claim 7, wherein said fixing means is applied with said tension by a driving friction force of a guide roller.

10. The fixing member as defined in claim 7, wherein said fixing means is applied with said tension by a weight of a dance roller.

11. The fixing member as defined in claim 7, wherein said fixing means includes a belt.

12. The fixing apparatus as defined in claim 7, wherein said toner has a viscosity within a range of from approximately 10 c poise to approximately $10^{13}$ c poise.

13. A method of image fixing, comprising the steps of:

receiving a recording sheet having a toner image thereof;

transferring said recording sheet;

applying heat and pressure to said recording sheet so that said toner becomes in a state higher than one of softening and melting points and is melted;

stopping the applying of the heat to said toner so that the melted toner is cooled down;

ejecting said recording sheet, when a temperature of said toner is reduced below one of said softening and melting points; and configuring said fixing means to have a thickness of S $\mu$m within a range of from approximately 1.0 $\mu$m to approximately 300 $\mu$m, said transferring step comprises using a belt having a thickness of S $\mu$m and a tension within a range of one of from approximately ((S+99)/50000)×9.8 100 N/m to approximately ((29S+371×3/50000)×9.8×100 N/m and from approximately ((S+99/40000)×9.8×100 N/m to approximately ((29S+371)×3/40000)×9.8×100 N/m.

14. The method of image fixing as defined in claim 13, wherein said using step comprises using said belt applied with said tension via a spring.

15. The method of image fixed as defined in claim 13, wherein said using step comprises using said belt applied with said tension via a driving friction force of a guide roller.

16. The method of image fixing as defined in claim 13, wherein said using step comprises using said belt applied with said tension via a weight of a dancer roller.

17. The fixing apparatus as defined in claim 13, wherein said toner has a viscosity within a range of from approximately 10 c poise to approximately $10^{13}$ c poise.

18. An image forming apparatus, comprising:

a fixing station comprising:

a fixing member configured to transfer a recording sheet having a toner image thereon and configured to apply heat to a front surface of said recording sheet; and a pair of pressure applying members mounted opposite to said fixing member relative to said recording sheet and configured to apply pressure to said recording sheet from a back side thereof, wherein said fixing member applies heat to said toner so that said toner becomes in a state higher than one of softening and melting points;

when said toner is melted, said fixing member stops applying heat to said toner so that the melted toner is cooled down;

when a temperature of said toner is reduced below one of said softening and melting points, said recording sheet is removed from said fixing member; and said fixing member has a thickness of S $\mu$m within a range of one of from approximately 1.0 $\mu$m to approximately 300 $\mu$m and a tension with a range of one of from approximately ((S+99)/50000)×9.8×100 N/m to approximately ((29S+371)×3/50000)×9.8×100 N/m and from approximately ((S+99/40000)×9.8×100 N/m to approximately ((29S+371)×3/40000)×9.8×100 N/m.

19. The fixing apparatus as defined in claim 18, wherein said toner has a viscosity within a range of from approximately 10 c poise to approximately $10^{13}$ c poise.

* * * * *